US006606807B1

(12) United States Patent
Nakamura

(10) Patent No.: US 6,606,807 B1
(45) Date of Patent: Aug. 19, 2003

(54) PAGE-TURNING APPARATUS AND PAGE-TURNING METHOD

(75) Inventor: Hirokatsu Nakamura, Kanagawa (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/184,580

(22) Filed: Nov. 3, 1998

(30) Foreign Application Priority Data

Apr. 27, 1998 (JP) ..... 10-116501

(51) Int. Cl.[7] ..... G09F 11/00
(52) U.S. Cl. ..... 40/476
(58) Field of Search ..... 40/476, 531, 532; 84/487; 235/379, 432

(56) References Cited

U.S. PATENT DOCUMENTS 4,280,036 A * 7/1981 Fukatsu
4,488,367 A * 12/1984 Yamauchi et al.
4,545,141 A * 10/1985 Ito et al.
4,700,497 A * 10/1987 Sato et al.
4,870,258 A * 9/1989 Mochizuki et al.
4,995,184 A * 2/1991 Ebato et al.
5,183,347 A * 2/1993 Higuchi et al. ..... 400/583.3
5,286,956 A * 2/1994 Mochizuki
5,794,365 A * 8/1998 Hindermeyer et al.

FOREIGN PATENT DOCUMENTS

| | | | |
|---|---|---|---|
| EP | 0459438 A1 | | 12/1991 |
| ES | 2 029 452 | | 9/1987 |
| JP | 63-231991 | | 9/1988 |
| JP | 01235696 | | 9/1989 |
| JP | 03169689 | | 7/1991 |
| JP | 4-22691 | | 1/1992 |
| JP | 04077296 | | 3/1992 |
| JP | 404275196 A | * | 9/1992 |
| JP | 408025839 A | * | 1/1996 |
| JP | 410297143 A | * | 11/1998 |

* cited by examiner

*Primary Examiner*—William L. Miller
(74) *Attorney, Agent, or Firm*—Staas & Halsey LLP

(57) ABSTRACT

A page-turning apparatus comprises a first roller and a second roller, and also a guide located between the first roller and second roller. The guide is supported with a arm. A bankbook is carried by the first roller and the second roller, and the second roller is locked while the first roller is rotated. With the rotation of the first roller, a page of the bankbook is warped and rejected. The guide swings along the warped and rejected page. By carrying the bankbook with the page as it is, the page can be turned over.

16 Claims, 15 Drawing Sheets

PAGE-TURNING APPARATUS AND PAGE-TURNING METHOD

FIELD OF THE INVENTION

The present invention relates to a page-turning apparatus having simple configuration and allowing size reduction, and to a page-turning method.

BACKGROUND OF THE INVENTION

In recent years, an ATM (Automated Teller Machine) or a window machine has been widely used as a portion of a computerized banking system. Incorporated in these types of machine is a page-turning apparatus for automatically turning pages of a bankbook when there is no printing space on an opened page. With this page-turning apparatus, a customer is not required to turn page himself or herself, which reduces a time required for transaction processing.

FIG. 13 is an explanatory view schematically showing an example of a page-turning apparatus based on the conventional technology. This page-turning apparatus 500 comprises a turning roller 503 located between a first carrier roller 501 and a second carrier roller 502. The first carrier roller 501 is paired with a first carrier tension roller 504. The second carrier roller 502 is paired with a second carrier tension roller 505. Also, the turning roller 503 is paired with a turning tension roller 506. A first guide 507 for turning in the regular direction is provided between the first carrier roller 501 and the turning roller 503.

The first guide 507 is rotatably supported at one edge thereof. The other edge of the first guide 507 has a curved section 507*a* for making a bankbook T easily be introduced. A second guide 508 for turning in the reverse direction is provided between the second carrier roller 502 and the turning roller 503. The second guide 508 is rotatably supported at one edge thereof. The other edge of the second guide 508 has a curved section 508*a* similar to that of the first guide 507. The first guide 507 and the second guide 508 are reversely operated to each other.

The first guide 507 and the second guide 508 form a carrier path with a lower-side guide 509. Located below the first guide 507 is a first pressure lever 510. Also, located below the second guide 508 is a second pressure lever 511. The pressure levers 510 and 511 are driven by first and second pressures MG 512 and 513 respectively. Located above the first guide 507 is a first sensor 514.

The first sensor 514 senses whether the first guide 507 is present or not. When the first guide 507 swings to be placed in front of the first sensor 514, the first sensor 514 senses the first guide 507. Similarly, located above the second guide 508 is a second sensor 515. The second sensor 515 senses whether the second guide 508 is present or not. When the second guide 508 swings to be placed in front of the second sensor 515, the second sensor 515 senses the second guide 508. A first roller lock MG 516 locks the first carrier roller 501. A second roller lock MG 517 locks the second carrier roller 502.

Next description is made for an operation of this page-turning apparatus 500. At first, as shown in FIGS. 14A to 14D, a bankbook T is carried in a direction of the left side in the figure with the first carrier roller 501 (FIG. 14A). In this case, the turning roller 503 also plays a roll as a carrier. Then, the first carrier roller 501 is locked by the first roller lock MG 516 in a state where the bankbook T is held with the first carrier roller 501 as well as with the turning roller 503. By locking the first carrier roller 501, the bankbook T can be locked.

Then, the turning roller 503 is rotated. The turning roller 503 and a page of the bankbook T are locked with friction therebetween. Accordingly, rotation of the turning roller 503 (FIG. 14B) makes the page warped. Also, the first pressure lever 510 pushes the bankbook T from the rear side thereof to help the page to easily be warped. The first guide 507 swings along the warped page. The first sensor 514 senses swinging of the first guide 507. Then, the turning roller 503 is rotated and the page is rejected (FIG. 14C).

The first sensor 514 senses the rejected page. When the page has been rejected, the first carrier roller 501 is released from being locked by the first roller lock MG 516. Then, the first carrier roller 501, turning roller 503, and the second carrier roller 502 are rotated to carry the bankbook T in a direction of the left side in the figure. A page of the bankbook T is turned over with this carrier (FIG. 14D). It should be noted that the page described above is generally used for indicating a face of any page on a book or a notebook, but is also used here to indicate each form of a bankbook or the like for convenience of description.

A page can reversely be turned over with a reverse operation thereto. As shown in FIGS. 15A to 15D, the bankbook is carried to the left side in the figure by the second carrier roller 502 (FIG. 15A). In this case, the turning roller 503 also plays a roll as a carrier.

Then, the second carrier roller 502 is locked by the second roller lock MG 517 in a state where the bankbook T is held with the second carrier roller 501 as well as with the turning roller 503. By locking the second carrier roller 502, the bankbook T can be locked. Then, the turning roller 503 is rotated in the reverse direction to the regular-turning of a page. Rotation of the turning roller 503 makes a page warped (FIG. 15B).

Also, the second pressure lever 511 pushes the bankbook T from the rear side thereof to help the page to easily be warped. The second guide 508 swings along the warped page. The second sensor 515 senses swinging of the second guide 508. Then, the turning roller 503 is rotated and the page is rejected (FIG. 15C).

The second sensor 515 senses the rejected page. When the page has been rejected, the second carrier roller 502 is released from being locked by the second roller lock MG 517. Then, the second carrier roller 502, turning roller 503, and the first carrier roller 501 are rotated to carry the bankbook T in a direction of the right side in the figure. A page of the bankbook T is reversely turned over with this carrier (FIG. 15D).

In the conventional type of page-turning apparatus 500, a page of a bankbook T can automatically be turned over when entry columns on the page run out. However, the conventional type of page-turning apparatus 500 requires two guides of the first guide 507 and the second guide 508 because page-turning is carried out in the regular direction as well as in the reverse direction.

The conventional type of page-turning apparatus 500 also requires two units of sensor 514, 515 for sensing swinging of both the first guide 507 and the second guide 508. And for this reason, the number of components resultantly increases, which makes the page-turning apparatus 500 complicated. In addition, the apparatus itself is made larger.

SUMMARY OF THE INVENTION

It is an object of the present invention to provide a page-turning apparatus enabling size reduction of the apparatus because of its simple structure, a page-turning method, and a computer-readable recording medium with a program for making a computer execute the method recorded therein.

To achieve the object described above, a page-turning apparatus according to the present invention comprises a first roller for carrying a brochure-formed medium having a plurality of pages, rotating or stopping independently, warping and rejecting a page by rotating, and locking a page by stopping; a second roller for carrying the brochure-formed medium together with the first roller, warping and rejecting a page by rotating in association with locking the page with the first roller, and locking the page by stopping in association with warping and rejecting the page by the first roller; and a guide section located between the first roller and second roller for guiding the object for page-turning and moving along a warped or rejected page.

A page is tuned over with the first roller and the second roller. For example, a page of an object for page-turning is locked by stopping the first roller, the page is rejected by rotating the second roller, the object is carried with the page rejected, and the page is turned over. The page is reversely turned over with the reverse operation. With this structure, the page can be turned over only with two rollers doubling as carrier rollers. Also, conventionally, as a turning roller is located between the two carrier rollers, two units of guide sections are required to form a carrier path. In the structure of the present invention, as page-turning in the regular and reverse directions is performed with two rollers, only one unit of guide is provided between the two rollers. For this reason, the structure of the apparatus is made simpler, which allows the apparatus to be minimized.

A page-turning apparatus according to the present invention comprises a first roller and a second roller located at a specified space between the rollers each rotating or stopping independently; and a guide section located between the first roller and second roller for guiding a brochure-formed medium having a plurality of pages and also rotating and swinging along a page warped or rejected by rotation of the first and second roller.

Conventionally, as a turning roller is located between the two carrier rollers, two units of guide sections are required to form a carrier path. In the structure of the present invention, as page-turning in the regular and reverse directions is performed with two rollers, only one unit of guide is provided between the two rollers. A warped form of a page in the page-turning in the regular direction is different from that in the reverse direction. In order to handle the different forms, the guide section is so constructed that the section rotates and swings along a warped or rejected page. For example, a guide is rotatably provided at the edge of a swinging arm. With this provision, the structure of the apparatus is made simpler, which allows the apparatus to be minimized.

A page-turning apparatus according to the present invention comprises a first roller for carrying a brochure-formed medium having a plurality of pages, rotating or stopping independently, warping and rejecting a page by rotating, and locking a page by stopping; a second roller for carrying the brochure-formed medium together with the first roller, warping and rejecting a page by rotating in association with locking the page with the first roller, and locking the page by stopping in association with warping and rejecting the page by the first roller; a guide section located between the first roller and second roller for guiding the object for page-turning and moving along a warped or rejected page; and a sensor for determining whether a page is warped or rejected according to movement of the guide section.

As the guide section moves along a warped or rejected page, the sensor can sense whether the page is warped or rejected according to the movement of the guide section. When the page is rejected, the object for page-turning is carried with the page rejected, and the page is turned over.

In a page-turning apparatus according to the present invention, a shielding plate is provided in the guide section, and the sensor determines whether a page is warped or rejected by sensing presence of this shielding plate.

As the guide section swings due to a warped or rejected page, the shielding plate is provided in this guide section. The sensor senses presence of this shielding plate. The sensor determines whether a page is warped or rejected according to whether the shielding plate is present or not.

A page-turning apparatus according to the present invention comprises a first roller and a second roller located at a specified space; a motor for rotating the first and second rollers; a transfer mechanism for transferring rotation of the motor; a locking section for locking the first roller and second roller; a guide section rotatably provided at an edge section of a swinging arm with the other edge section thereof pivotally supported and located between the first roller and second roller; and a sensor for sensing presence of a shielding plate provided on the arm.

Specifically, the first roller and the second roller are rotated by the motor as well as through the transfer mechanism. Also, the rotation of the first roller or the second roller is locked by the locking section. A page is rejected by, for instance, locking the second roller with the locking section and rotating the first roller. The guide section rotates and swings along a rejected page. A page can be turned over by carrying a brochure-formed medium with the page rejected. By locking the first roller and rotating the second roller, the page can reversely be turned over. Even with this structure, only one unit is required as the guide section, and for this reason, the apparatus has a simple structure, which allows the apparatus to be minimized.

A page-turning apparatus according to the present invention further comprises a roller control section for controlling rotation and stopping of the first roller as well as of second roller.

The roller control section locks, when a page is to be turned, for example, in the regular direction, the second roller and rotates the first roller. When a page is to be turned in the reverse direction, the roller control section locks the first roller and rotates the second roller. The roller control section comprises a CPU for a computer and a program with a sequence recorded therein.

A page-turning method according to the present invention comprises a step of locking a page of a brochure-formed medium having a plurality of pages by stopping either one of a first and second rollers located at a specified space therebetween and rejecting a page by rotating the other roller; and a page turning step of turning a page by transferring the brochure-formed medium to the side of the page rejected by the first or second roller.

In this method, a page is turned in the regular and reverse directions by using both the first roller and second roller. A brochure-formed medium is carried also by the first roller and second roller. Accordingly, there is no need to provide a turning roller between the two units of carrier roller like in the conventional technology. For this reason, there is a smaller number of objects to be controlled, which allows a page to easily be turned over.

A page-turning method according to the present invention comprises a step of locking a page of a brochure-formed medium having a plurality of pages by stopping either one of a first roller and a second roller located at a specified space therebetween and rejecting the page by rotating the other roller; a step of swinging a guide section for guiding the brochure-formed medium along a rejected page in the rejecting step above and determining rejection of the page by sensing this guide section with a sensor; and a page-turning step of turning a page, after rejection of the page is determined, by transferring the brochure-formed medium to the side of page rejected by the first or second roller.

A page is rejected by, for example, locking the page of a brochure-formed medium with the stopped first roller and rotating the second roller. When the page is rejected, the guide section swings along the page. The sensor senses the swinging of the guide section and a control section or the like determines rejection of the page according to output from the sensor. When the page is rejected, the brochure-formed medium is carried with the page rejected and the page is turned over.

Other objects and features of this invention will become understood from the following description with reference to the accompanying drawings.

DESCRIPTION OF THE PREFERRED EMBODIMENT

Detailed description is made hereinafter for the page-turning apparatus and page-turning method according to the present invention with reference to the related drawings. It should be noted that the present invention is not limited by the embodiments described below.

Figure 1:
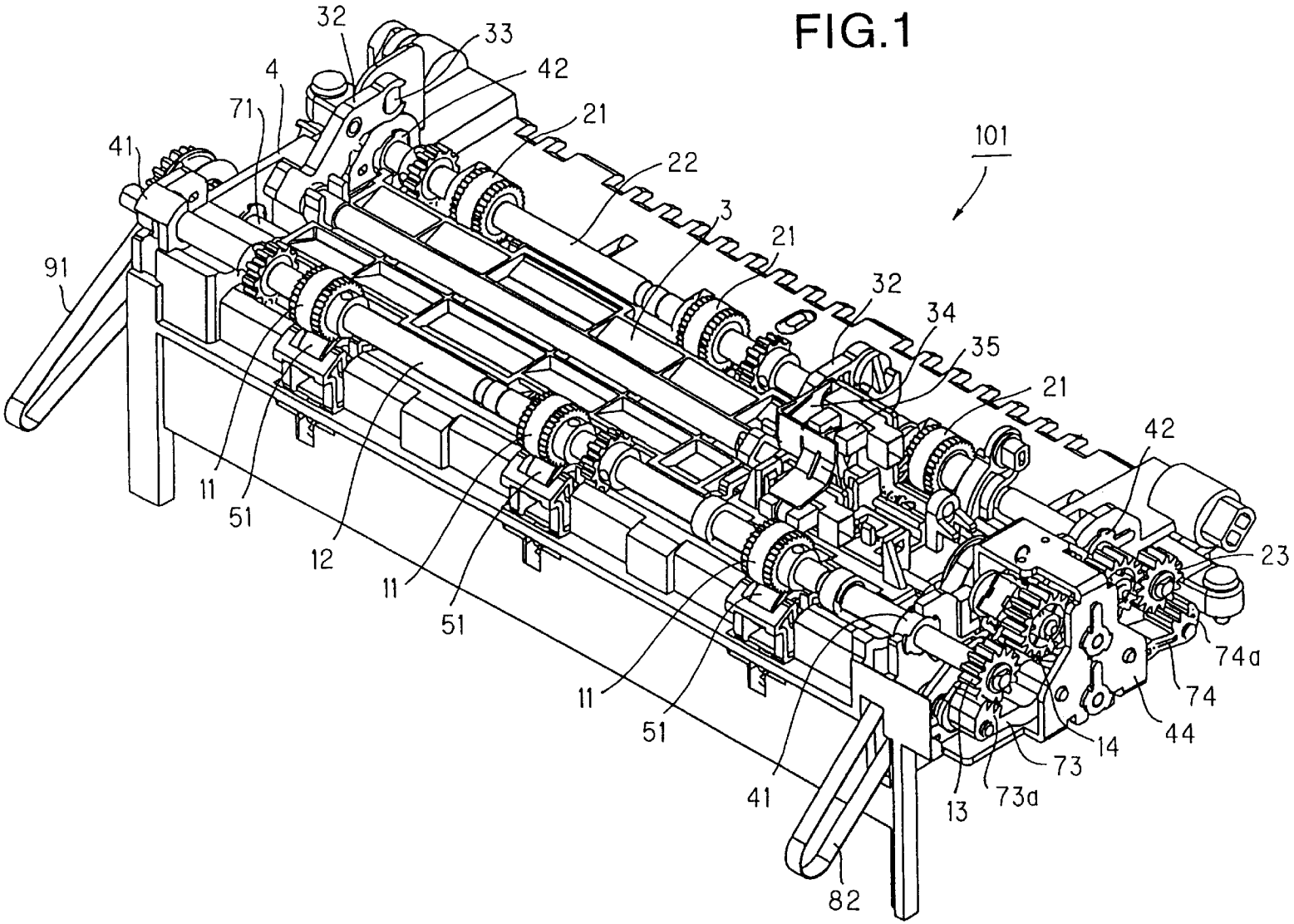
FIG. 1 is a perspective view showing a mechanical section of the page-turning apparatus according to Embodiment 1 of the present invention.
Figure 2:
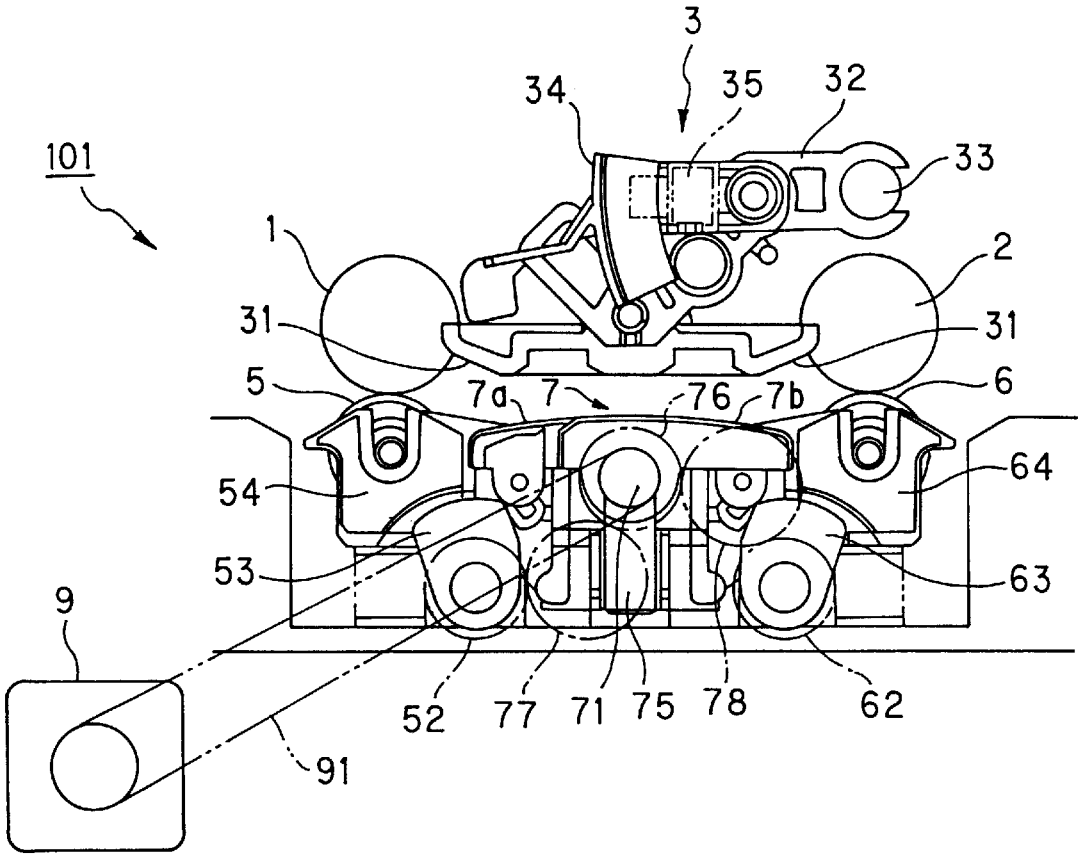
FIG. 2 is a schematic side view of the page-turning apparatus shown in FIG. 1.
Figure 3:
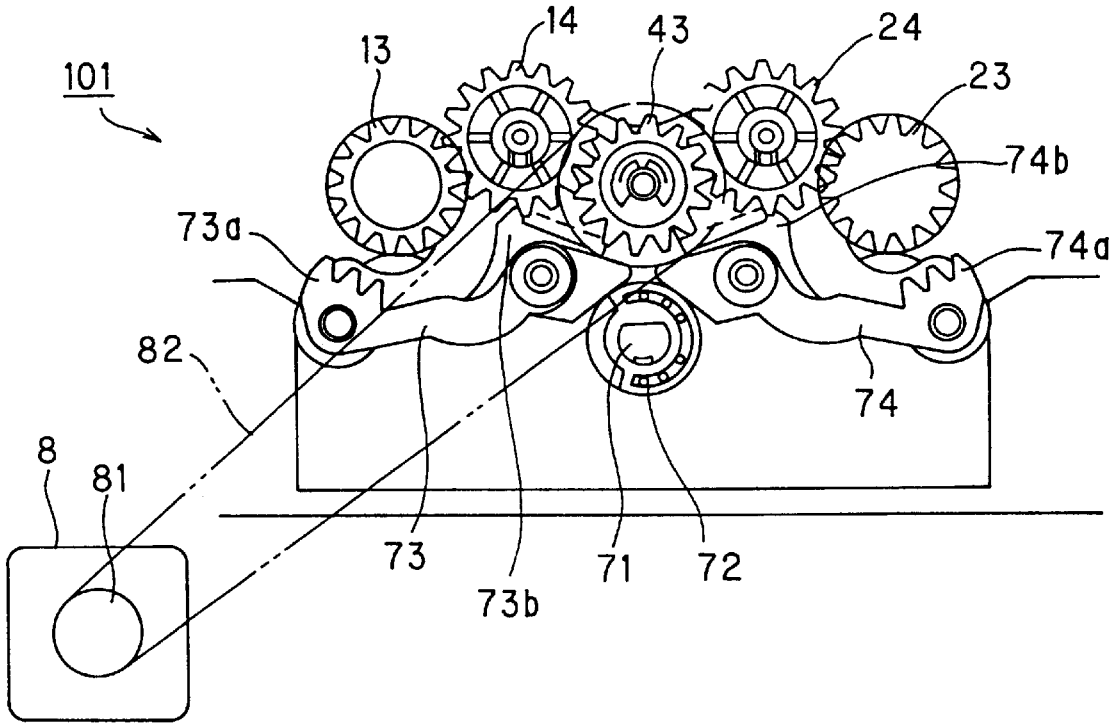
FIG. 3 is an explanatory view showing a row of driving wheels of the page-turning apparatus shown in FIG. 1.

FIG. 1 is a perspective view showing a mechanical part of a page-turning apparatus according to Embodiment 1 of the present invention. FIG. 2 is a schematic side view of the page-turning apparatus shown in FIG. 1. FIG. 3 is an explanatory view showing a row of driving wheels of the page-turning apparatus shown in FIG. 1.

This page-turning apparatus 100 comprises a first roller 1, a second roller 2, and a unit of guide 3 located therebetween. The first roller 1 comprises a plurality of rollers 11 provided on a first shaft 12. Both edges of the first roller 1 are rotatably supported by bearings 41 provided in a frame 4.

The first roller 1 is paired with a first tension roller 5. The first tension roller 5 also comprises a plurality of rollers 51 provided on a shaft. Similarly, the second roller 2 comprises a plurality of rollers 21 provided on a second shaft 22. Both edges of the second roller 2 are rotatably supported by bearings 42 provided in the frame 4. The second roller 2 is paired with a second tension roller 6. The second tension roller 6 also comprises a plurality of rollers provided on a shaft.

The guide 3 has tapered sections 31 at both edges thereof. This guide 3 forms a carrier path with a pressure 7. The <-shaped arms 32 are pivotally supported at both edges of the frame 4. Each of the arms 32 can swing around a frame mounting section 33. The guide 3 is rotatably supported at the other edge of the arm 32. Mounted on the arm 32 is also a shielding plate 34. The shielding plate 34 has a sector shape with a semi-cylindrical section. A sensor 35 is located opposite to the shielding plate 34. A position of this sensor 35 is fixed. The shielding plate 34 swings together with the arm 32.

A first gear 13 is mounted on one edge of the first shaft 12. Also, a second gear 23 is mounted on one edge of the second shaft 22. A rotator 43 is pivotally supported on the center of the top section of the frame 4. The first gear 13 is coupled to the rotator 43 through a first intermediate gear 14. Similarly, the second gear 23 is coupled to the rotator 43 through a second intermediate gear 24. The first intermediate gear 14 is pivotally supported with a long hole (not shown). The first intermediate gear 14 swings along the long hole.

Similarly, the second intermediate gear 24 is pivotally supported with a long hole (not shown). The second intermediate gear 24 swings along the long hole. Located below a page-turning mechanism 101 is a carrier motor 8. A step motor is used for the carrier motor 8. Mounted on a shaft of this carrier motor 8 is a gear 81. A timing belt 82 is stretched between the gear 81 and the rotator 43.

Provided below the rotator 43 is a driving shaft 71. A cam 72 is mounted on the driving shaft 71. This cam 72 swings first and second lock levers 73 and 74. Tooth sections 73*a* and 74*a* are formed at edges of the first and second lock levers 73 and 74 respectively. The tooth sections 73*a* and 74*a* engage teeth of the first and second gear 13 and 23 respectively.

Rotary shafts of the first and second lock levers 73 and 74 are pivotally supported by a gear box 44 provided on the frame 4.

Provided on the first and second lock levers 73 and 74 are hammers 73*b* and 74*b* for pushing upward the first and second intermediate gears 14 and 24. When the hammers 73*b* and 74*b* push upward the first and second intermediate gears 14 and 24, the first and second intermediate gears 14 and 24 swing and cut off a row of the wheels.

A pressure lever 75 is located below the carrier path. This pressure lever 75 rotates together with the driving shaft 71. The pressure 7 comprises a first pressure 7*a* and a second pressure 7*b*. The first and second pressure 7*a* and 7*b* have the same rotary shaft. A motor 9 for driving a mechanism is located below the page-turning mechanism 101. A step motor is used for the mechanism-driving motor 9. A timing belt 91 is stretched between this mechanism-driving motor 9 and the driving shaft 71.

A driving wheel 76 is provided on the driving shaft 71. The driving wheel 76 is coupled to a first cam wheel 52 through a first driving intermediate wheel 77. Provided on the first cam wheel 52 is a first tension roller moving-off cam 53. The first tension roller moving-off cam 53 contacts a bearing 54 of the first tension roller 5. Similarly, the driving wheel 76 is coupled to a second cam wheel 52 through a second driving intermediate wheel 78. Provided on the second cam wheel 62 is a second tension roller moving-off cam 63. The second tension roller moving-off cam 63 contacts a bearing 64 of the second tension roller 6.

Figure 4:
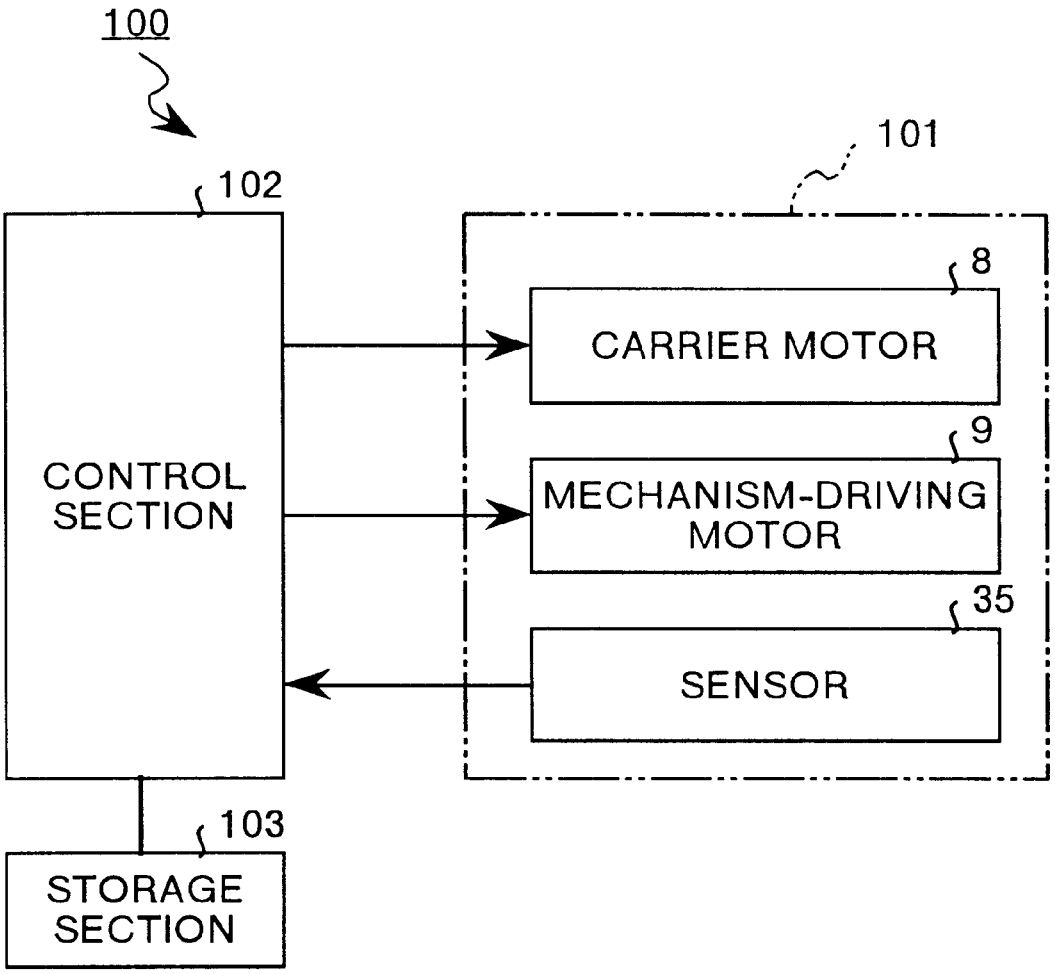
FIG. 4 is a block diagram showing the page-turning apparatus according to the present invention.

FIG. 4 is a block diagram showing this page-turning apparatus 100. The page-turning apparatus 100 comprises the page-turning mechanism 101 and a control section 102. Provided in the control section 102 is a storing section 103 for storing therein a program for an operational sequence. The control section 102 provides controls for rotational movement of the carrier motor 8 as well as of the mechanism-driving motor 9. The control section 102 fetches a signal from the sensor 35. It should be noted that a CPU for a personal computer is used for the control section 102, and a recording medium such as a floppy disk with a computer-readable program recorded therein can also be used for the storing section 103.

Figure 5:
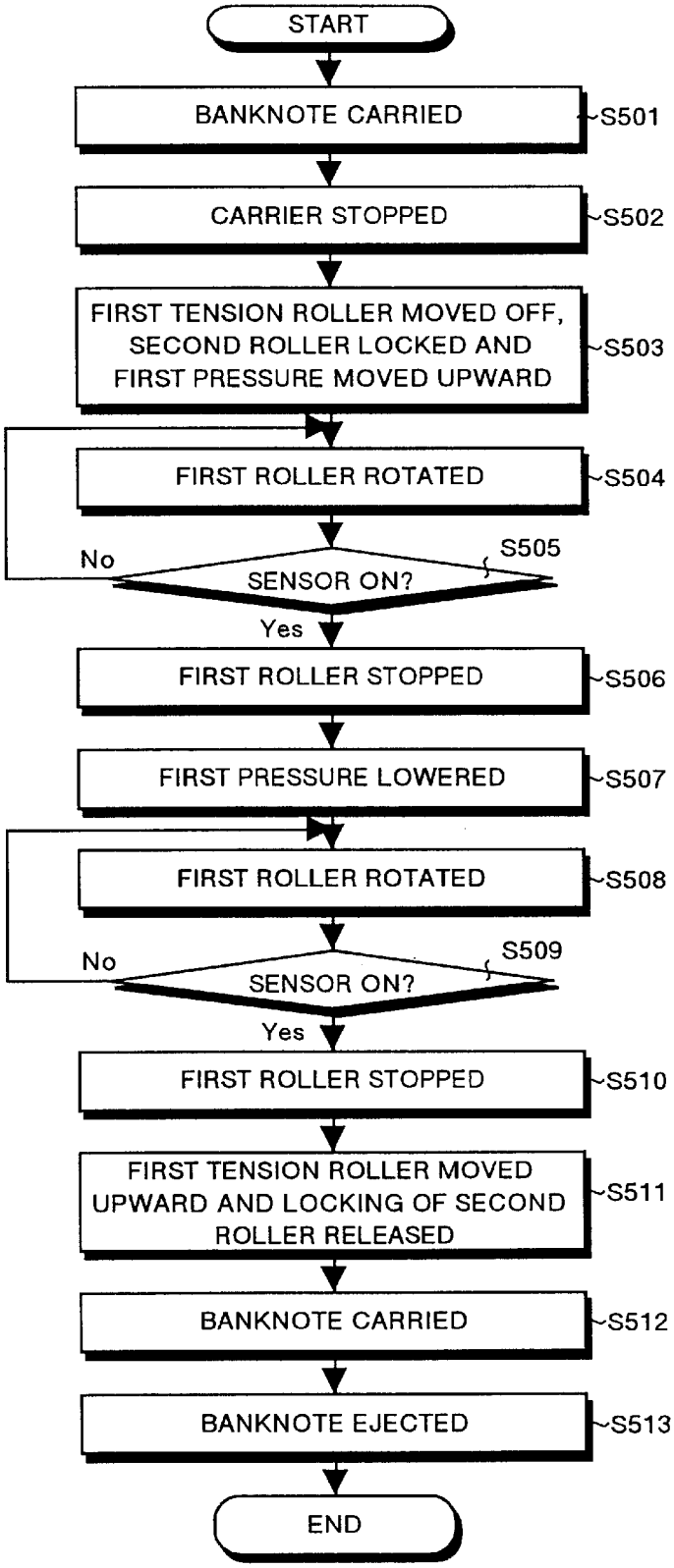
FIG. 5 is a flow chart showing an operation of the page-turning apparatus.

FIG. 5 is a flow chart showing an operation of this page-turning apparatus 100. FIGS. 6A to 6D are explanatory views showing an operation of page-turning in the regular direction. FIGS. 7A to 7D are explanatory views showing operation of page-turning in the reverse direction. The controls described below are provided by the control section 102.

In step S501, a banknote T is carried by rotating the first roller 1 and the second roller 2. In step S502, the carrier is stopped when one side TL of the banknote T contacts both of the first roller 1 and the second roller 2. As a feed rate can be estimated from a size of the bankbook T, the carrier motor 8 is rotated by that feed rate.

Figure 6C:
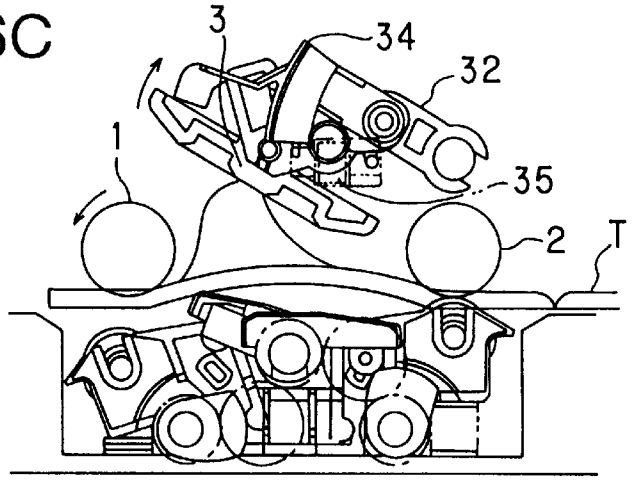
FIGS. 6A to 6D are explanatory views showing an operation of page-turning in the regular direction.
Figure 6D:
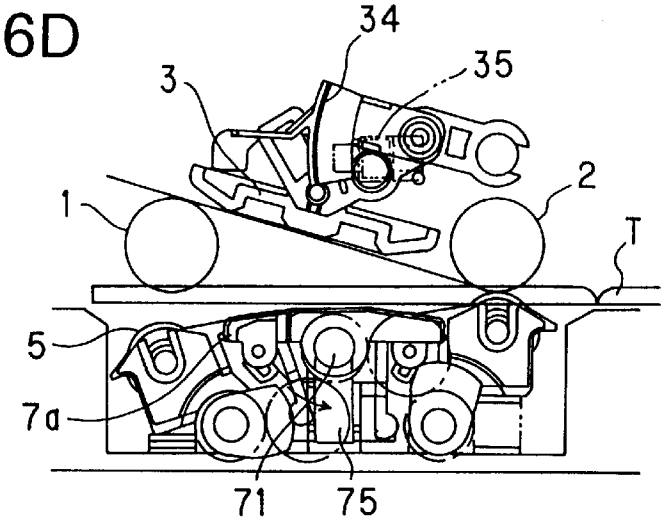
Figure 6A:
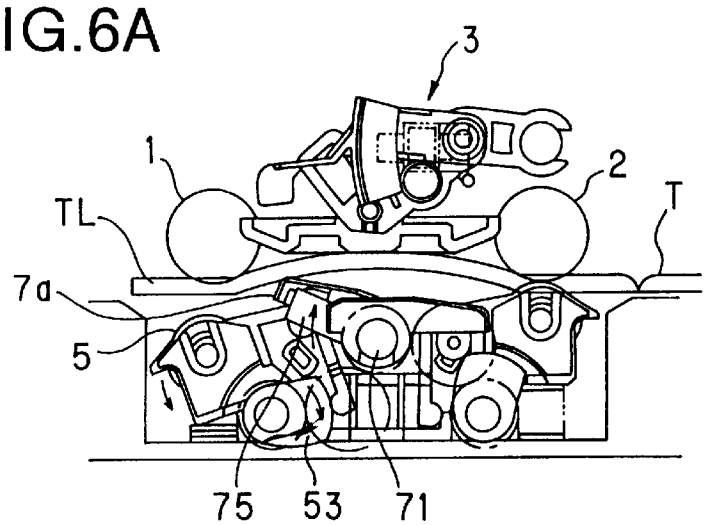

In step S503, an operation of page-turning is prepared (FIG. 6A). At first, the first tension roller 5 is moved off. The first tension roller moving-off cam 53 rotates by rotating the driving shaft 71 with the mechanism-driving motor 9. Then, the first tension roller 5 is moved off downward.

Figure 6B:
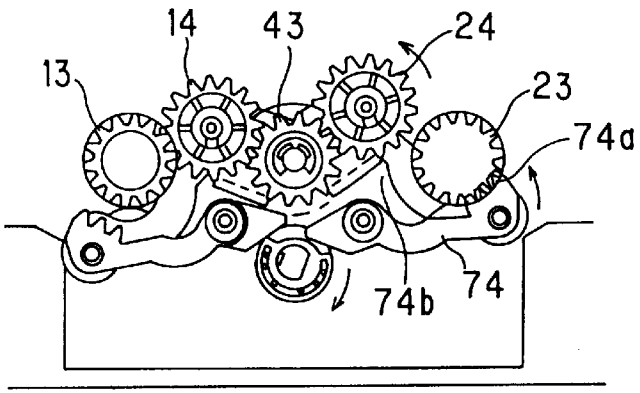

Also, the hammer 74*b* pushes upward the second intermediate gear 24 with rotation of the driving shaft 71. With this operation, the row of wheels from the rotator 43 to the second gear 23 is cut off. Further, the second lock lever 74 is actuated with rotation of the driving shaft 71. When the tooth section 74*a* of the second lock lever 74 engages the second gear 23 of the second roller 2, the second roller 2 is locked (FIG. 6B). Also, the pressure lever 75 rotates with rotation of the driving shaft 71 to push the first pressure 7*a* upward. When the first pressure 7*a* goes upward, the bankbook T is pushed upward (FIG. 6A).

In step S504, the first roller 1 rotates. When the rotator 43 rotates with the carrier motor 8, the rotation is transferred to the first gear 13 through the first intermediate gear 14. The first roller 1 rotates together with the first gear 13. A page of the bankbook T and the first roller 1 are engaged with friction therebetween. A place near the center of the bankbook T is pressed with the second roller 2. For this reason, when the first roller 1 rotates, a page of the bankbook T is warped (FIG. 6C). The guide 3 rotates and swings with the arm 32 along the warped page.

In step S505, the sensor 35 senses whether the shielding plate 34 is present or not. The shielding plate 34 swings in association with swinging of the arm 32, but the sensor 35 does not move. For this reason, after the arm 32 swings a certain degree, the shielding plate 34 moves away from the sensor. The sensor 35 outputs a signal when the shielding is cleared. The first roller 1 rotates until the sensor 35 outputs a signal (FIG. 6C).

In step S506, the rotation of the first roller 1 is stopped according to the output signal from the sensor 35. In step S507,the first pressure 7*a* is lowered. The pressure lever 75 returns to the original position by reversely rotating the driving shaft 71. With this operation, the first pressure 7*a* goes down (FIG. 6D). In step S508, the first roller 1 is further rotated. With the rotation of the first roller 1, a page of the bankbook T is rejected over the roller (FIG. 6D).

In step S509, determination is made as to whether a page is rejected or not. When it is determined that the page has been rejected, the guide 3 goes down. When the shielding plate 34 goes down together with the guide 3, the shielding plate 34 comes in front of the sensor 35. Accordingly, rejection of a page can be determined according to a signal from the sensor (FIG. 6D).

In step S510, the rotation of the first roller 1 is stopped. In step S511, locking of the second roller 2 by the second lock lever 74 is released and also the second intermediate gear 24 is connected to the row of wheels. Also, the moved off first tension roller 5 is moved upward. In step S512, the bankbook T is carried to the left side in the figure. By carrying the bankbook T thereto, the page of the bankbook T can be turned over. After the page is turned over, the bankbook T is ejected (step S513).

Figure 7C:
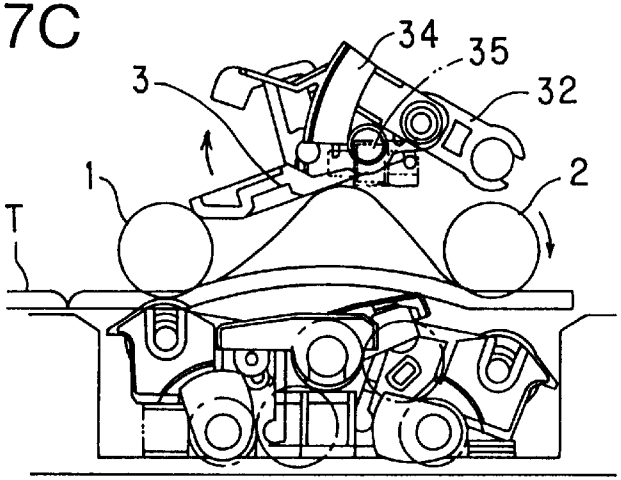
FIGS. 7A to 7D are explanatory views showing an operation of page-turning in the reverse direction.
Figure 7D:
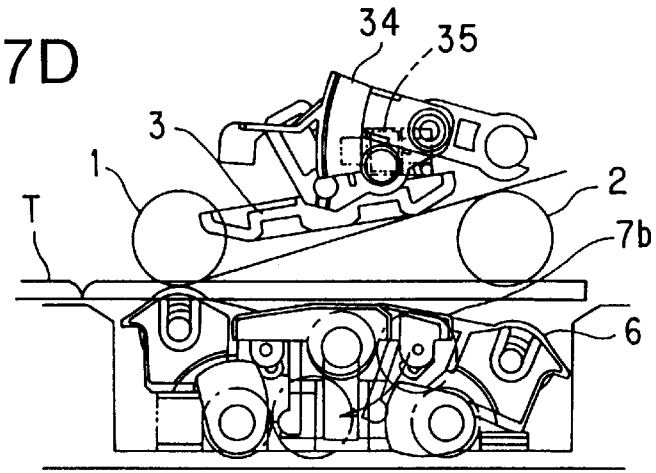
Figure 7A:
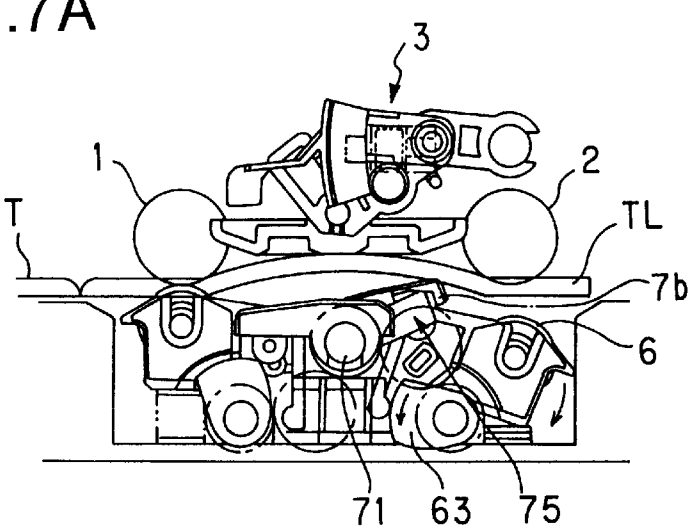

Next description is made for a case where a page is turned in the reverse direction. The reverse operation to the operation described above is required when a page is turned in the reverse direction. Simple description is made for the operation in the same manner as described above. The operation is the same as that of the case in FIG. 5, so that the figure thereof is omitted. At first, a bankbook T is carried by rotating the first roller 1 and the second roller 2. Then, the carrier thereof is stopped when one side TL of the bankbook T contacts both of the second roller 2 and the first roller 1. Then, an operation of page-turning is prepared (FIG. 7A).

At first, the second tension roller 6 is moved off. The second tension roller moving-off cam 63 rotates by rotating the driving shaft 71 with the mechanism-driving motor 9, and the second tension roller 6 is moved off downward.

Figure 7B:
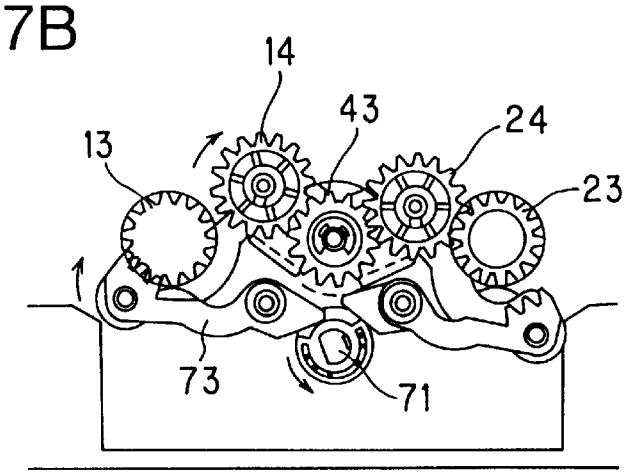

With rotation of the driving shaft 71, the first intermediate gear 14 is pushed upward, and the row of wheels from the rotator 43 to the first gear 13 is cut off. Further, with the rotation of the driving shaft 71, the first lock lever 73 is actuated and the first roller 1 is locked (FIG. 7B). The pressure lever 75 rotates with rotation of the driving shaft 71, which pushes the second pressure 7*b* upward. When the second pressure 7*b* goes upward, the bankbook T is pushed upward (FIG. 7A).

Then, when the rotator 43 rotates with the carrier motor 8, the second roller 2 rotates through the second intermediate gear 24 and the second gear 23. A place near the center of the bankbook T is pressed with the first roller 1. For this reason, when the second roller 2 rotates, a page of the bankbook T is warped (FIG. 7C). The guide 3 rotates and swings with the arm 32 along the warped page.

In the next step, the sensor 35 senses whether the shielding plate 34 is present or not. The sensor 35 outputs a signal when the shielding is cleared. The second roller 2 rotates until the sensor 35 outputs a signal. Then, the rotation of the second roller 2 is stopped according to the output signal from the sensor 35. When the rotation of the second roller 2 is stopped, the second pressure 7*b* is lowered (FIG. 7D). With further rotation of the second roller 2, a page of the bankbook T is rejected over the roller. When the page has been rejected, the shielding plate 34 goes down together with the guide 3.

For this reason, the sensor 35 can determine rejection of a page. In the next step, rotation of the second roller 2 is stopped. Also, locking of the first roller 1 by the first lock lever 73 is released and also the first intermediate gear 14 is connected to the row of wheels. Also, the moved-off second tension roller 6 is moved upward. Then, the bankbook T is carried to the right side in the figure. By carrying the bankbook T thereto, the page of the bankbook T can reversely be turned over. After the page is turned over, the bankbook T is ejected.

Although the page-turning of a bankbook has been described above, a brochure-formed medium as an object for page-turning is not limited thereto. Any bound medium such as a notebook can be used. An object of the invention to be applied is not limited to ATM of a bank. It is applicable to some machine such as a copying machine.

Figure 8:
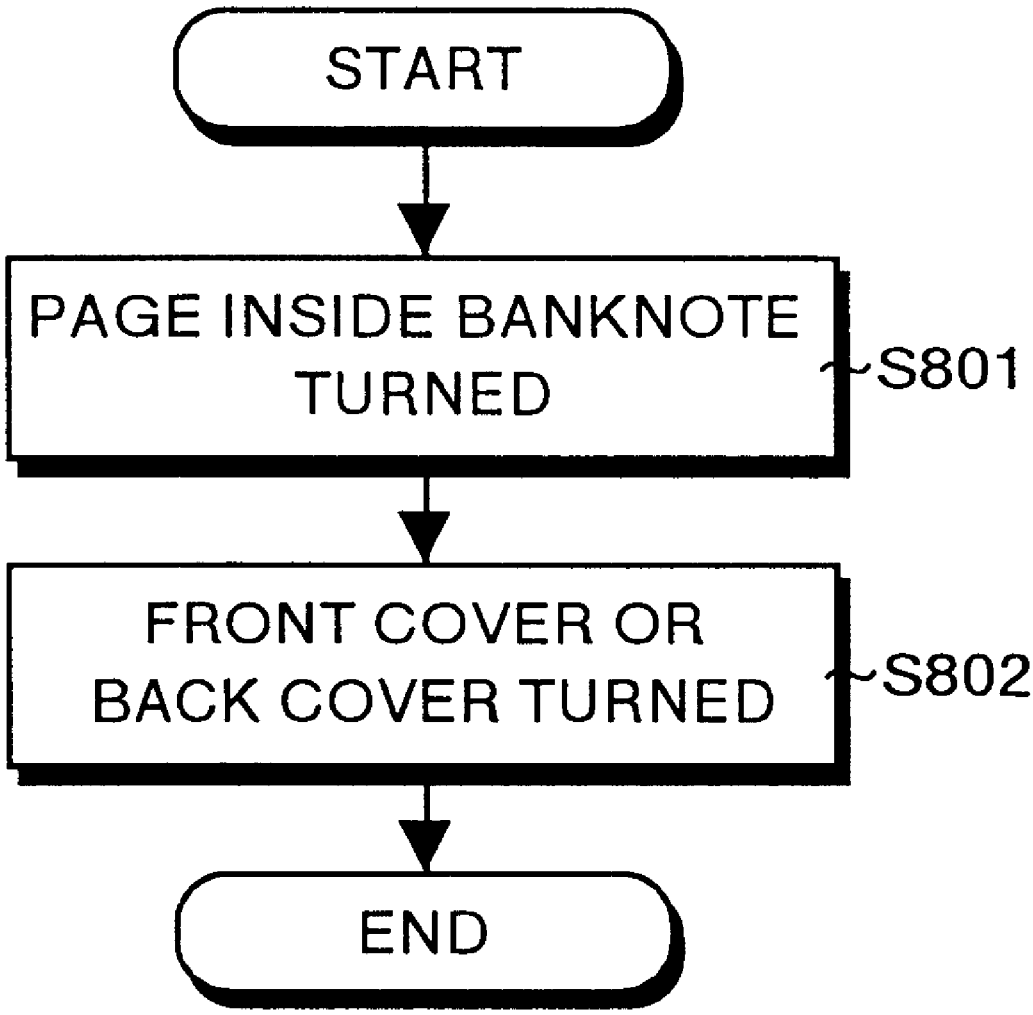
FIG. 8 is a flow chart showing an operation of the page-turning apparatus according to Embodiment 2 of the present invention.

The page-turning can also be controlled as described below by using the page-turning apparatus 100 according to Embodiment 1. This invention can securely turn a firm front cover or back cover of a bankbook. The control section provides controls described below. FIG. 8 is a flow chart shown an operation of a page-turning apparatus according to Embodiment 2. In step S801, an operation of turning a page inside a bankbook is performed. In step S802, an operation of turning a front cover or a back cover thereof is performed.

Figure 9:
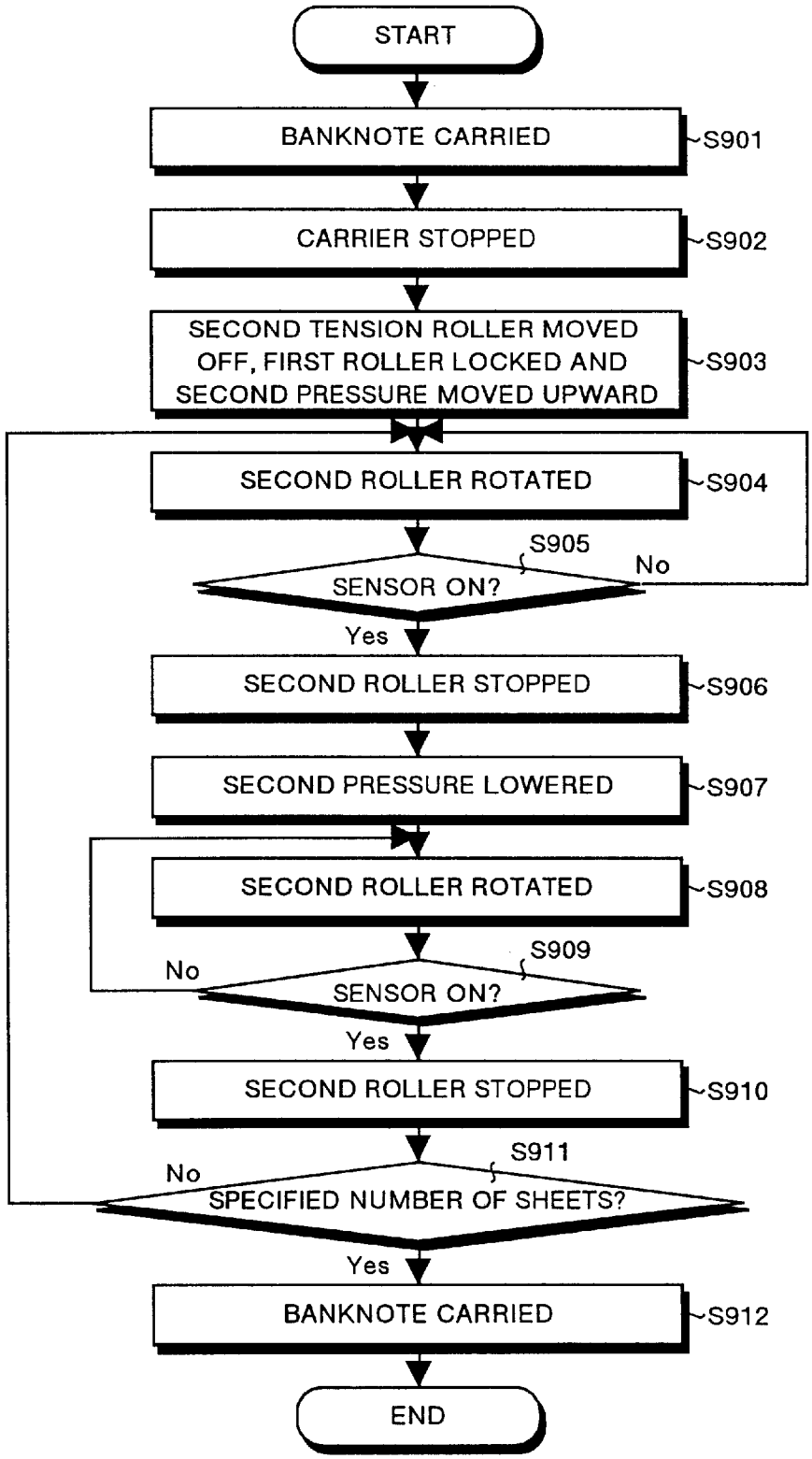
FIG. 9 is a flow chart showing an operation of turning a page inside a bankbook.

FIG. 9 is a flow chart showing an operation of turning a page inside a bankbook. FIGS. 10A to 10D are explanatory views showing an operation of turning a page in the regular direction. As for the operation of turning a page inside thereof, the operation of turning a page shown in Embodiment 1 is repeatedly performed until the turning of the last page inside the bankbook is ended.

In step S901, a bankbook T is carried by rotating the first roller 1 and the second roller 2. In step S902, the carrier thereof is stopped when one side TL of the bankbook T contacts both of the first roller 1 and the second roller 2.

Figure 10C:
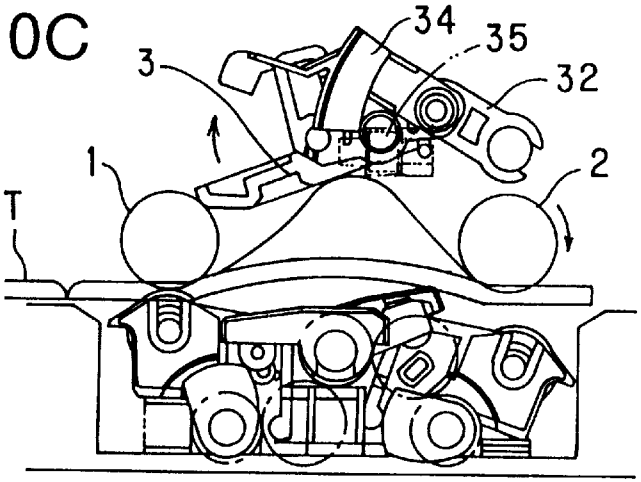
FIGS. 10A to 10D are explanatory views showing an operation of page-turning in the regular direction.
Figure 10D:
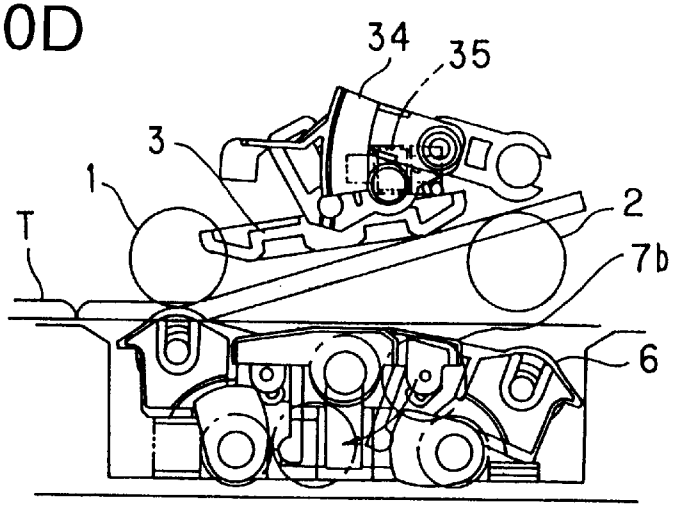
Figure 10A:
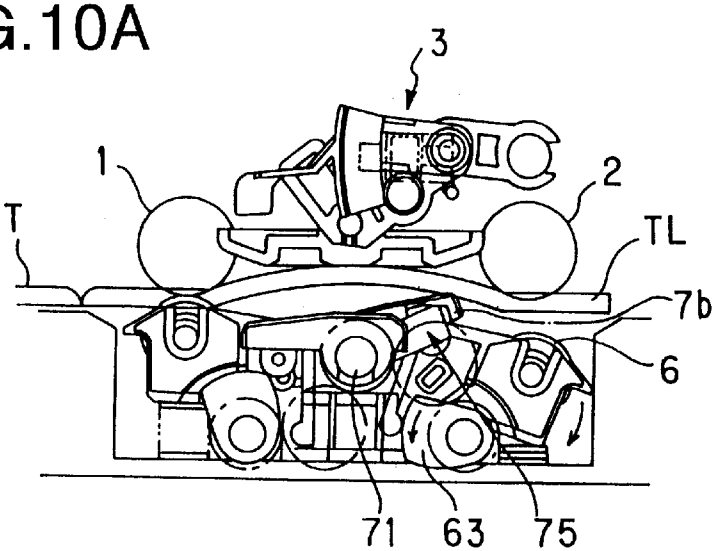

In step S903, an operation of page-turning is prepared (FIG. 10A). At first, the second tension roller 6 is moved off. The second tension roller moving-off cam 63 rotates by rotating the driving shaft 71 with the mechanism-driving motor 9, and the second tension roller 6 is moved off downward.

Figure 10B:
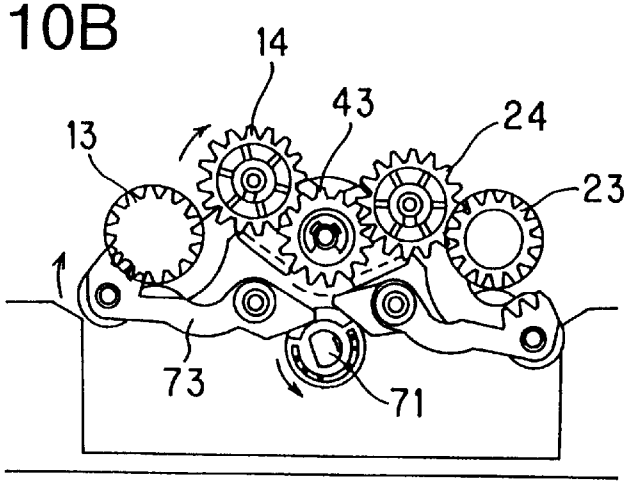

With rotation of the driving shaft 71, the first intermediate gear 14 is pushed upward, and the row of wheels from the rotator 43 to the first gear 13 is cut off. Further, with the rotation of the driving shaft 71, the first lock lever 73 is actuated and the first roller 1 is locked (FIG. 10B). The pressure lever 75 rotates with the rotation of the driving shaft 71, and the second pressure 7*b* is pushed upward. When the second pressure 7*b* goes upward, the bankbook T is pushed upward (FIG. 10A) .

In step S904, the second roller 2 is rotated. On the other hand, a place near the center of the bankbook T is pressed with the first roller 1. For this reason, when the second roller 2 rotates, a page of the bankbook T is warped (FIG. 10C). The guide 3 rotates and swings with the arm 32 along the warped page.

In step S905, the sensor 35 senses whether the shielding plate 34 is present or not. The sensor 35 outputs a signal when the shielding is cleared. The second roller 2 rotates until the sensor 35 outputs a signal (FIG. 10C). In step S906, the rotation of the second roller 2 is stopped according to the output signal from the sensor 35.

In step S907, the second pressure 7*b* is lowered. When the driving shaft 71 is reversely rotated, the pressure lever 75 returns to the original position. With this operation, the second pressure 7*b* goes down (FIG. 10D). In step S908, the second roller 2 is further rotated. With the rotation of the second roller 2, a page of the bankbook T is rejected over the roller (FIG. 10D).

In step S909, determination is made as to whether a page is rejected or not. When it is determined that the page has been rejected, the shielding plate 34 goes down together with the guide 3 and comes in front of the sensor 35. Accordingly, rejection of a page can be determined according to a signal from the sensor. In step S910, the rotation of the second roller 2 is stopped.

In step S911, determination is made as to whether a specified number of pages inside the bankbook is rejected or not. This determination is executed, for example, by reading contents of a magnetically recording section attached on each page thereof (not shown). When it is determined that a specified number of pages is not rejected, the operation of rejecting a page is carried out again (step S904–step S910). When the specified number of pages has been rejected, the processing goes onto step S912.

In step S912, the bankbook T is carried with the specified number of pages rejected. By carrying the bankbook T, a plurality of pages can be turned over in one step. Then, the operation of turning pages inside the bankbook is ended, and the processing shifts to an operation of turning a front cover or a back cover thereof.

When pages inside thereof is turned in the reverse direction, the second roller 2 is locked while the first roller 1 is rotated. Although the pages inside the bankbook are turned one by one in the description above, all the pages may be turned in one step. Also, the pages may be turned in a plurality of steps. The time required until the bankbook is ejected can be reduced by decreasing the number of steps of turning.

Figure 11:
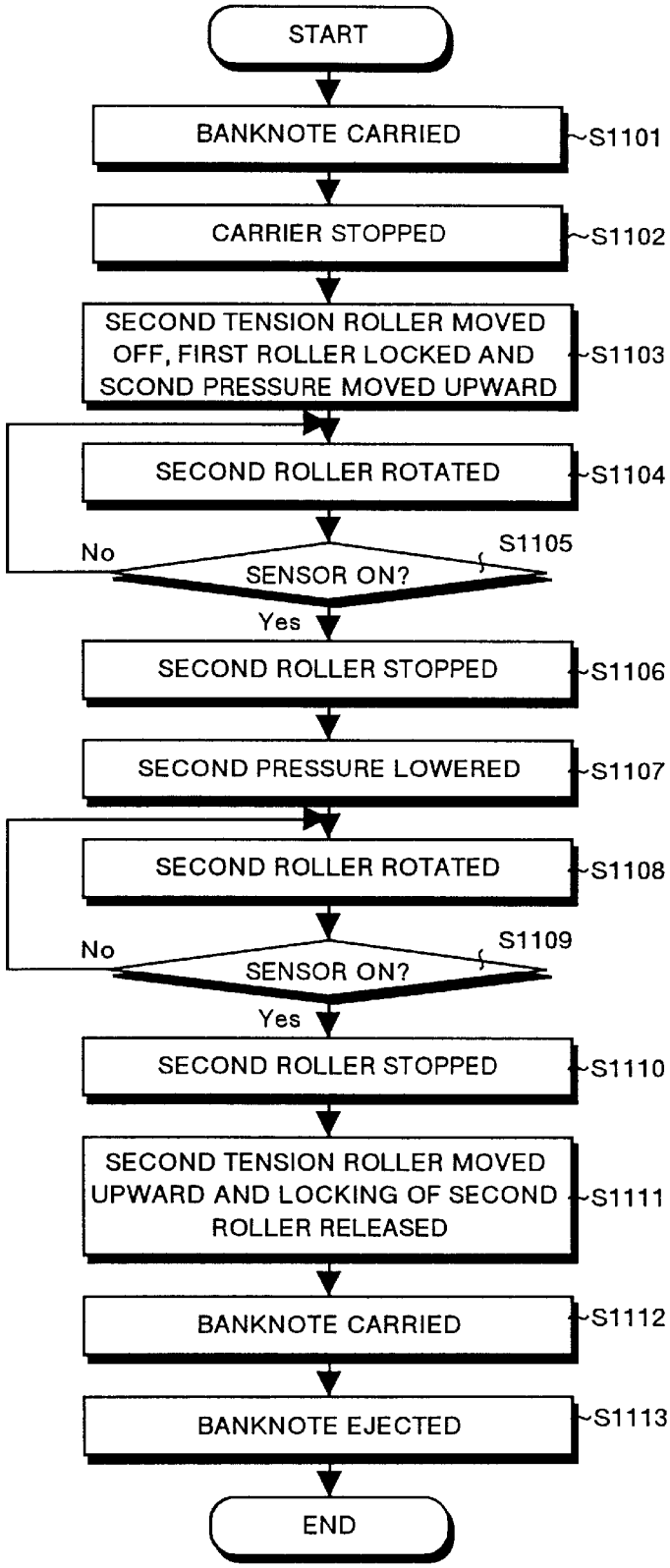
FIG. 11 is a flow chart showing an operation of turning a front or back cover of a bankbook.

FIG. 11 is a flow chart showing an operation of turning a front cover or a back cover of a bankbook. FIGS. 12A to 12D are explanatory views showing an operation of page-turning of a front cover or a back cover thereof. In step S1101, a bankbook T with all the pages inside thereof turned is carried by rotating the first roller 1 and the second roller 2. In step S1102, the carrier thereof is stopped when one side TL of the bankbook T contacts both of the first roller 1 and the second roller 2.

Figure 12C:
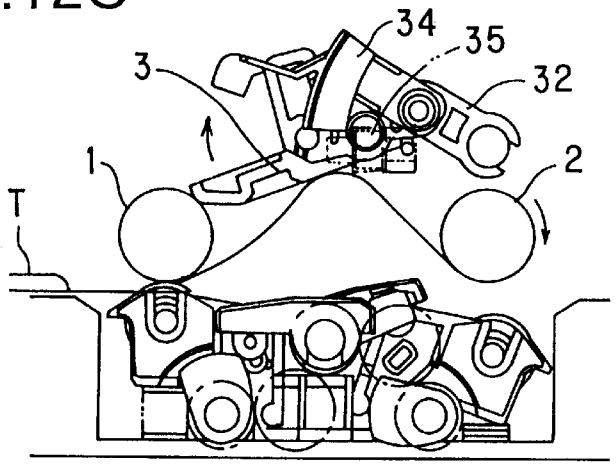
FIGS. 12A to 12D are explanatory views showing an operation of turning a front or back cover of a bankbook.
Figure 12A:
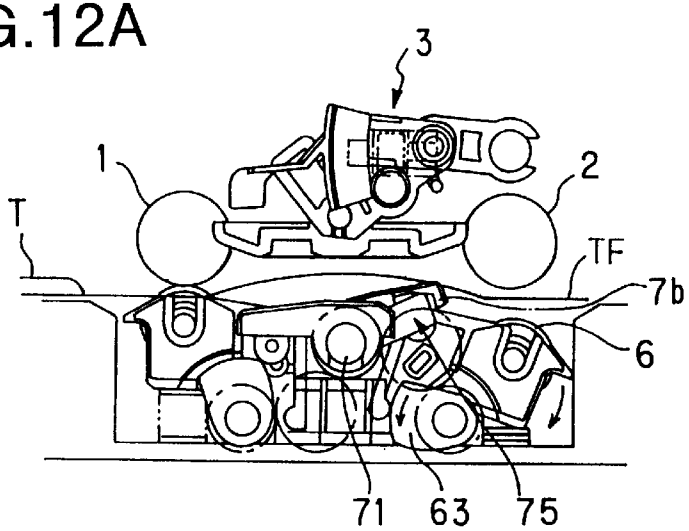

In step S1103, an operation of page-turning is prepared (FIG. 12A). At first, the second tension roller 6 is moved off. The second tension roller moving-off cam 63 rotates by rotating the driving shaft 71 with the mechanism-driving motor 9, and the second tension roller 6 is moved off downward.

Figure 12D:
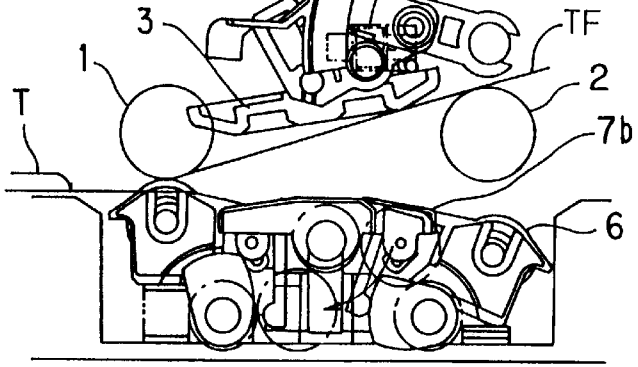
Figure 12B:
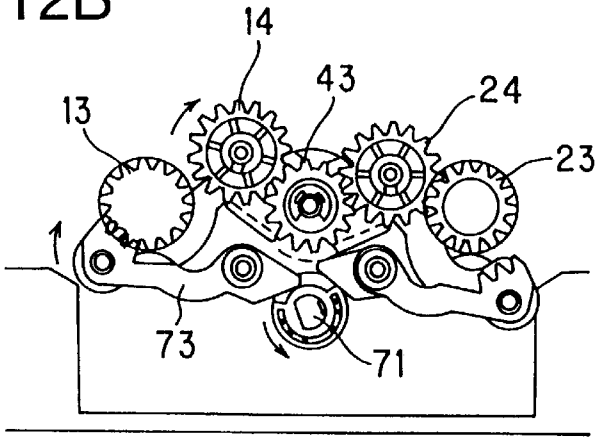
Figure 13:
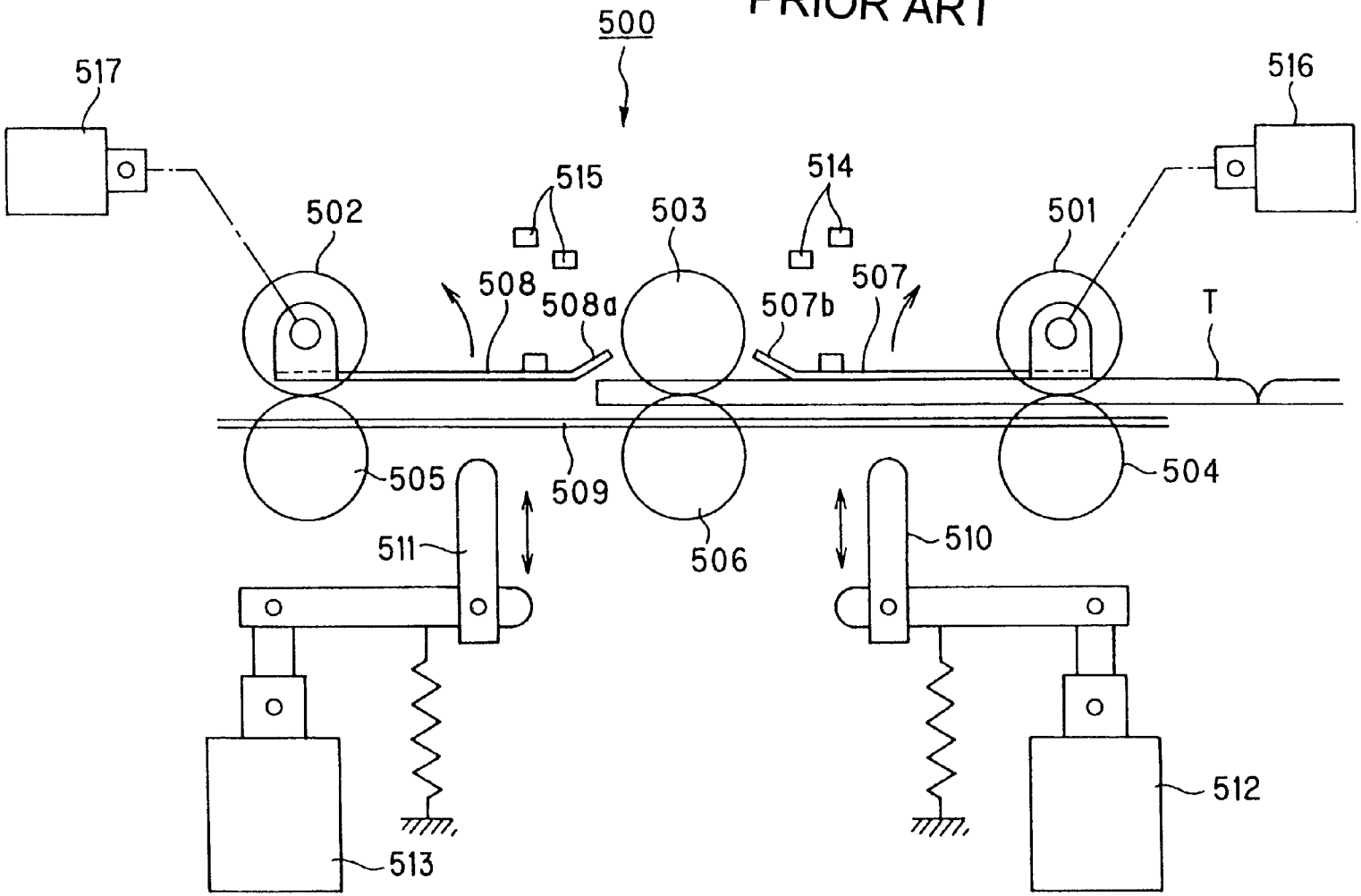
FIG. 13 PRIOR ART
FIG. 13 is an explanatory view schematically showing an example of the page-turning apparatus based on the conventional technology.
Figure 14B:
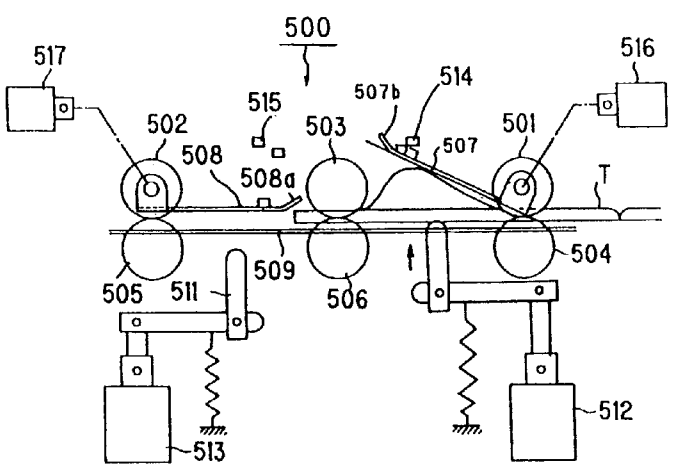
FIG.14B (PRIOR ART)
FIGS. 14A to 14D are explanatory views showing an operation of the page-turning apparatus shown in FIG. 13.
Figure 14A:
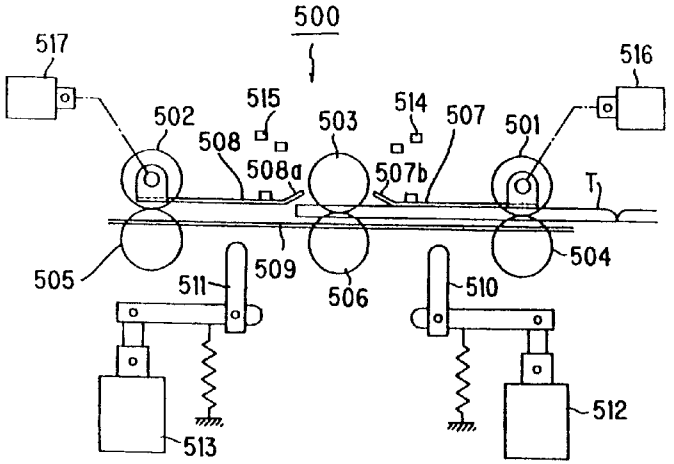
FIG.14A (PRIOR ART)
Figure 14D:
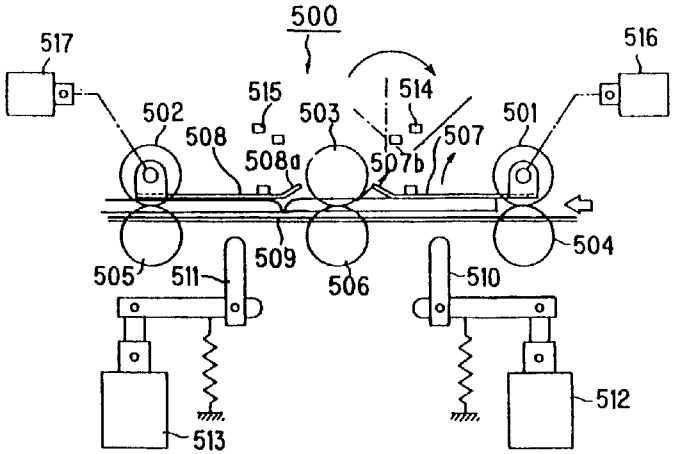
FIG.14D (PRIOR ART)
Figure 14C:
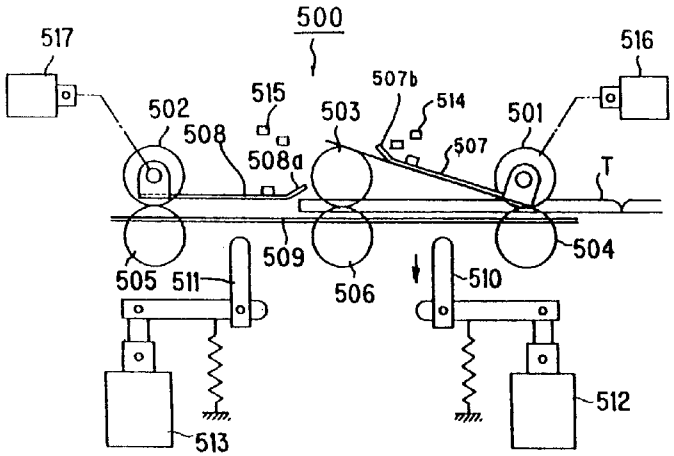
FIG.14C (PRIOR ART)
Figure 15B:
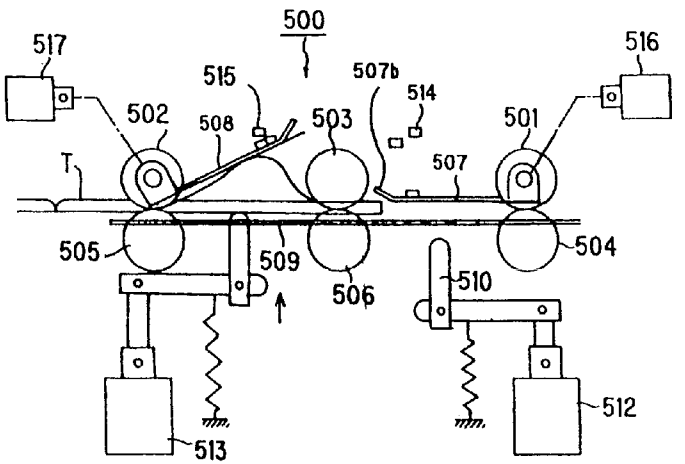
FIG.15B (PRIOR ART)
FIGS. 15A to 15D are explanatory views showing an operation of the page-turning apparatus shown in FIG. 13.
Figure 15A:
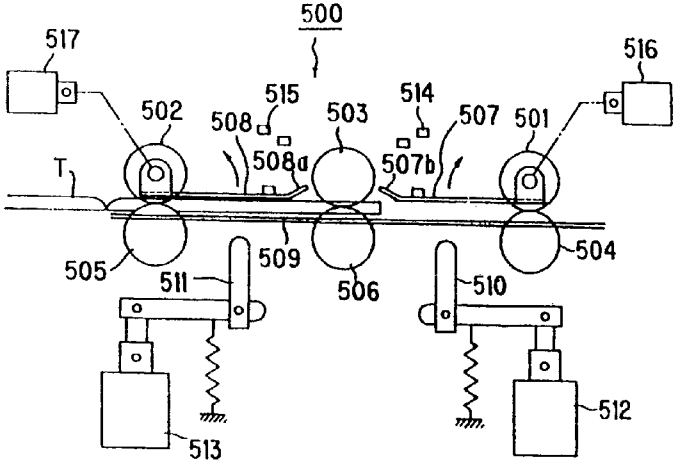
FIG.15A (PRIOR ART)
Figure 15D:
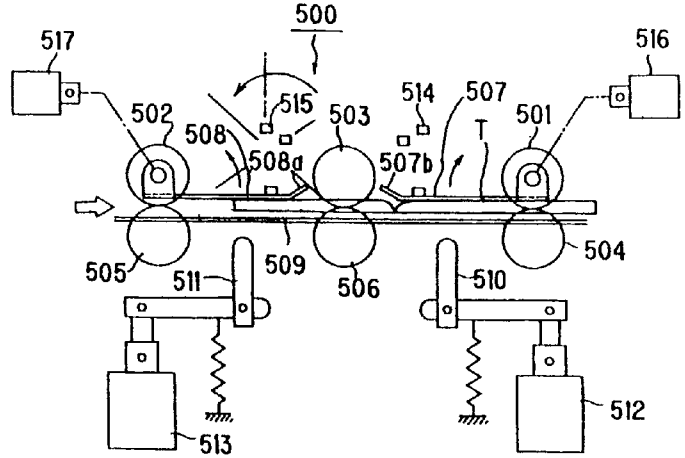
FIG.15D (PRIOR ART)
Figure 15C:
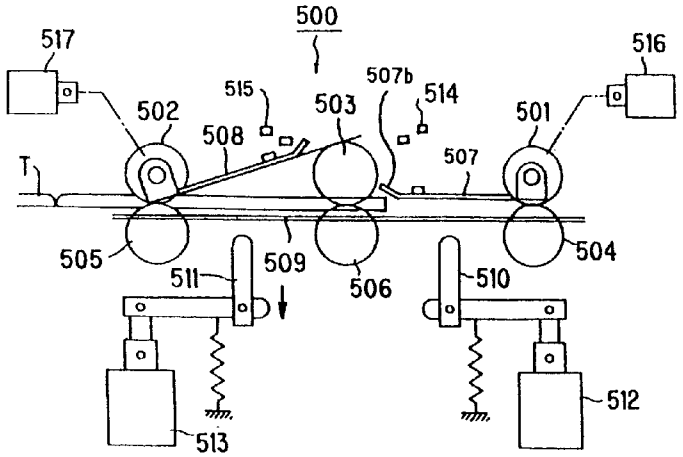
FIG.15C (PRIOR ART)

With rotation of the driving shaft 71, the first intermediate gear 14 is pushed upward, and the row of wheels from the rotator 43 to the first gear 13 is cut off. Further, with the rotation of the driving shaft 71, the first lock lever 73 is actuated and the first roller 1 is locked (FIG. 12B). The pressure lever 75 rotates with the rotation of the driving shaft 71, which pushes upward the second pressure 7*b*. When the second pressure 7*b* goes upward, the bankbook T is pushed upward (FIG. 12A).

In step S1104, the second roller 2 is rotated. On the other hand, a place near the center of the bankbook T is pressed with the first roller 1. For this reason, when the second roller 2 rotates, a front cover TF of the bankbook T is warped (FIG. 12C). The guide 3 rotates and swings with the arm 32 along the warped front cover TF.

In step S1105, the sensor 35 senses whether the shielding plate 34 is present or not. The sensor 35 outputs a signal when the shielding is cleared. The second roller 2 rotates until the sensor 35 outputs a signal (FIG. 12C). In step S1106, the rotation of the second roller 2 is stopped according to the output signal from the sensor 35.

In step S1107, the second pressure 7*b* is lowered. When the driving shaft 71 is reversely rotated, the pressure lever 75 returns to the original position. With this operation, the second pressure 7*b* goes down (FIG. 12D). In step S1108, the second roller 2 is further rotated. With the rotation of the second roller 2, the front cover TF of the bankbook T is rejected over the roller (FIG. 12D).

In step S1109, determination is made as to whether the front cover TF is rejected or not. When it is determined that the front cover TF has been rejected, the shielding plate 34 goes down together with the guide 3 and comes in front of the sensor 35. Accordingly, rejection of the front cover can be determined according to a signal from the sensor (FIG. 12D). In step S1110, the rotation of the second roller 2 is stopped.

In step S1111, locking of the first roller 1 by the first lock lever 73 is released and also the first intermediate gear 14 is connected to the row of wheels. Also, the moved-off second tension roller 6 is moved upward. In step S1112, the bankbook T is carried to the right side in the figure. By carrying the bankbook T, the front cover TF of the bankbook T can be turned over. After the front cover TF has been turned over, the bankbook T is ejected (step S1113).

In the description above, the front cover TF of a bankbook is turned, but when the back cover thereof is to be turned, the second roller 2 is locked while the first roller 1 is rotated. As the front cover and back cover thereof are hard, a pressure force of the first or second tension roller is previously set to a higher value.

The structure of Embodiment 1 may be modified although it is not shown in the figure. For example, only the first roller 1 and the second roller 2 are required, but the guide 3 may be excluded. That is because a bankbook is only required to be kept open during a transferring process.

Also, in Embodiment 1, the sensor 35 is provided opposite to the shielding plate 34, but may be provided on the frame 4 to directly sense warping of a page. In this case, the shielding plate 34 is not needed.

The guide 3 is only required to move along a warped and rejected page, so that the guide is not necessarily supported with the arm 32. The guide may be supported with an elastic body such as a spring.

As described above, with the page-turning apparatus according to the present invention, a page is turned with a first roller and a second roller, so that only one unit of guide is provided between the two rollers. For this reason, the structure of the apparatus is made simpler, which allows the apparatus to be minimized.

With the page-turning apparatus according to another aspect of the present invention, a guide section moves along a warped or rejected page, so that warping or rejection of the page can be sensed by the sensor from the movement thereof. And for this reason, page-turning can accurately be performed.

With the page-turning apparatus according to another aspect of the present invention, rotation of a motor is transferred to the first roller and the second roller through a transfer mechanism, and the rollers are stopped with a locking section. Even if the above system is employed, only one unit of guide section is required, so that the structure of the apparatus is made simpler, which allows the apparatus to be minimized.

With the page-turning apparatus according to another aspect of the present invention, the apparatus further comprises a roller control section for controlling rotation and stopping of the first and second rollers, so that efficient control by a computer can be obtained.

With the page-turning method according to another aspect of the present invention, the method comprises a step of locking a page of an object for page-turning by stopping either one of the first roller and the second roller located at a specified space, rotating and rejecting the other roller; and a page-turning step of turning a page by carrying a brochure-formed medium to the side of the page rejected by the first or second roller, so that there are a smaller number of objects to be controlled, which allows a page to easily be turned over.

With the page-turning method according to another aspect of the present invention, a sensor senses whether the guide section swings or not, and determines rejection of a page, so that page-turning can accurately be controlled.

This application is based on Japanese patent application No. HEI 10-116501 filed in the Japanese Patent Office on Apr. 27, 1998, the entire contents of which are hereby incorporated by reference.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A page turning apparatus comprising:

a first roller for carrying a brochure-formed medium having a plurality of pages, rotating about a first axis or stopping independently, warping and rejecting a page by rotating, and locking a page by stopping;

a second roller for carrying said brochure-formed medium together with the first roller, warping and rejecting a page by rotating about a second axis in association with locking the page with said first roller, and locking the page by stopping in association with warping and rejecting the page by said first roller;

a swing arm rotated about a third axis at a first end thereof, by a warped or rejected page; and a guide that guides said brochure-formed medium and is rotated about a fourth axis at a second end of the swing arm, by the warped or rejected page.

2. A page-turning apparatus according to claim 1 further comprising:

a roller control section for controlling rotation and stopping of said first roller and said second roller.

3. The page turning apparatus according to claim 1, wherein a range of rotation of the swing arm about the swing arm axis is less than 360 degrees.

4. A page-turning apparatus comprising:

a first roller and a second roller having a predetermined space therebetween, said first roller rotating about a first axis or stopping independently, and said second roller rotating about a second axis or stopping independently; and a swing arm located between said first roller and said second roller and rotated about a third axis at a first end thereof, by a brochure-formed medium having a plurality of pages and a guide that guides the brochure-formed medium having a plurality of pages, contacts and is rotated about a fourth axis at a second end of the swing arm, by the brochure-formed medium.

5. The page-turning apparatus according to claim 4 further comprising:

a roller control section for controlling rotation and stopping of said first roller and said second roller.

6. A page-turning apparatus comprising:

a first roller for carrying a brochure-formed medium having a plurality of pages, rotating about a first axis or stopping independently, warping and rejecting a page by rotating, and locking a page by stopping;

a second roller for carrying said brochure-formed medium together with said first roller, warping and rejecting a page by rotating about a second axis in association with locking of the page by said first roller, and locking the page by stopping in association with warping and rejecting the page by said first roller;

a guide section that guides said brochure-formed medium, the guide section comprising:

a swing arm located between said first roller and second roller and rotating about a third axis at a first end thereof, by a warped or rejected page and a guide that can be rotated about a fourth axis at a second end of the swing arm, by the warped page; and a sensor that determines whether a page is warped or rejected.

7. The page-turning apparatus according to claim 6 further comprising:

a roller control section for controlling rotation and stopping of said first roller and said second roller.

8. A page-turning apparatus comprising:

a first roller for carrying a brochure-formed medium having a plurality of pages, rotating or stopping independently, warping and rejecting a page by rotating, and locking a page by stopping;

a second roller for carrying said brochure-formed medium together with said first roller, warping and rejecting a page by rotating in association with locking of the page by said first roller, and locking the page by stopping in association with warping and rejecting the page by said first roller;

a guide section located between said first roller and said second roller for guiding said brochure-formed medium and moving along a warped or rejected page; and a sensor for determining whether a page is warped or rejected according to the movement of said guide section, wherein a shielding plate is provided in said guide section and said sensor determines whether a page is warped or rejected by detecting a presence of said shielding plate.

9. A page-turning apparatus comprising:

a first roller and a second roller located at a specified distance therebetween;

a motor for rotating said first roller and said second roller;

a transfer mechanism for transferring rotational force of said motor to said first roller and said second roller;

a locking section for locking said first roller and said second roller;

an arm pivotably supported at one end and having a shielding plate;

a guide section rotatably provided at another end of said arm and located between said first roller and said second roller;

a sensor for detecting a presence or absence of said shielding plate provided on said arm.

10. The page-turning apparatus according to claim 9 further comprising:

a roller control section for controlling rotation and stopping of said first roller and said second roller.

11. A page-turning apparatus comprising:

a first roller and a second roller positioned with a predetermined space therebetween, each roller being independently rotated and stopped; and a pivotable guide section to guide a flexible medium having a plurality of pages and to rotate or swing along a warped or rejected page in association with rotation of the first or second roller, the guide section comprising:

a swing arm located between said first roller and second roller and rotating about a swing arm axis at a first end thereof by the warped or rejected page, and a guide rotating about a guide axis at a second end of the swing arm to guide the flexible medium and be rotated by the warped or rejected page.

12. An apparatus for moving and guiding a flexible medium having a plurality of pages comprising:

an independently rotating and stopping first roller that is adapted to move the flexible medium along a path, said first roller being adapted to warp and reject a page by rotating and lock a page by stopping;

an independently rotating and stopping second roller that is adapted to move the flexible medium together with said first roller, said second roller being positioned so as to warp and reject a page by rotating in association with the page adapted to be locked with said first roller, and to lock the page by stopping in association with the page being warped and rejected by said first roller; and a pivotable guide section to guide the medium for page-turning and to move a warped or rejected page along said path, the guide section comprising:

a swing arm located between said first roller and second roller and rotating about a swing arm axis at a first end thereof by the rejected page, and a guide rotating about a guide axis at a second end of the swing arm to guide the flexible medium and be rotated by the rejected page.

13. A page turning apparatus to operate on a medium having a plurality of pages comprising:

a first roller;

a second roller to move said medium together with said first roller; and a guide section, the guide section comprising:

a swing arm located between said first roller and second roller and rotating about a swing arm axis at a first end thereof by a warped or rejected page, and a guide rotating about a guide axis at a second end of the swing arm to guide the medium and be rotated by the warped or rejected page.

14. A page turning apparatus to operate on a medium having a plurality of pages, comprising:

a first roller;

a second roller to move the medium together with said first roller; and a guide section, the guide section comprising:

a swing arm located between said first roller and second roller and rotating about a swing arm axis at a first end thereof by a warped or rejected page, and a guide rotating about a guide axis at a second end of the swing arm to guide the medium and be rotated by the warped or rejected page.

15. A page turning apparatus to operate on a medium having a plurality of pages, comprising:

a first roller;

a second roller to move the medium together with said first roller; and a guide section, the guide section comprising:

a swing arm located between said first roller and second roller and rotating about a swing arm axis at a first end thereof by a warped or rejected page, and a guide rotating about a guide axis at a second end of the swing arm to guide the medium and be rotated by the warped or rejected page.

16. A page turning apparatus according to claim 15, wherein said guide section is adapted to swing upward from the medium.

* * * * *